US011663946B2

(12) United States Patent
Kim et al.

(10) Patent No.: US 11,663,946 B2
(45) Date of Patent: May 30, 2023

(54) DRIVING CHIP AND DISPLAY DEVICE INCLUDING THE SAME

(71) Applicant: Samsung Display Co., Ltd., Yongin-si (KR)

(72) Inventors: Jiwoong Kim, Suwon-si (KR); Ohjo Kwon, Suwon-si (KR); Ikhyun Kim, Seongnam-si (KR); Hyunggun Ma, Seoul (KR); Kyungtea Park, Seoul (KR); Seongjoo Lee, Suwon-si (KR); Keumdong Jung, Seoul (KR); Sanghyun Heo, Hwaseong-si (KR); Donghyun Hwang, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/723,820

(22) Filed: Apr. 19, 2022

(65) Prior Publication Data

US 2022/0383788 A1 Dec. 1, 2022

(30) Foreign Application Priority Data

May 25, 2021 (KR) ..... 10-2021-0066907

(51) Int. Cl.
*G09G 3/20* (2006.01)

(52) U.S. Cl.
CPC ..... *G09G 3/20* (2013.01); *G09G 2310/027* (2013.01); *G09G 2310/0286* (2013.01); (Continued)

(58) Field of Classification Search
CPC ..... G09G 3/20; G09G 2310/027; G09G 2310/0286; G09G 2310/0289; G09G 2310/0291
See application file for complete search history.

(56) References Cited

U.S. PATENT DOCUMENTS 9,305,508 B2 4/2016 Park et al.
2006/0028414 A1 2/2006 Kimura et al.
(Continued)

FOREIGN PATENT DOCUMENTS

KR 100764047 B1 10/2007
KR 102105408 B1 4/2020
KR 102140643 B1 8/2020

OTHER PUBLICATIONS

Extended European Search Report for Application No. 22175578.8 dated Jan. 18, 2023.

*Primary Examiner* — Sejoon Ahn
(74) *Attorney, Agent, or Firm* — Cantor Colburn LLP

(57) ABSTRACT

A driving chip includes a data channel block including a plurality of data channels, a scan channel block disposed in a first direction from the data channel block and including a plurality of scan channels, a data pad block disposed outside the data channel block and the scan channel block in the first direction and including a plurality of data pads which respectively receive a data signal from the plurality of data channels, and a scan pad block disposed outside the data channel block and the scan channel block in the first direction, disposed outside the data pad block in a second direction crossing the first direction and including a plurality of scan pads which respectively receive a scan signal from the scan channels.

23 Claims, 17 Drawing Sheets

(52) U.S. Cl.
CPC ..... *G09G 2310/0289* (2013.01); *G09G 2310/0291* (2013.01)

(56) References Cited

U.S. PATENT DOCUMENTS

| | | | | |
|---|---|---|---|---|
| 2013/0077005 | A1 | 3/2013 | Kim et al. | |
| 2016/0035321 | A1 | 2/2016 | Cho et al. | |
| 2017/0154579 | A1 | 6/2017 | Choi et al. | |
| 2021/0027682 | A1* | 1/2021 | An | G09G 3/006 |
| 2021/0027704 | A1* | 1/2021 | Tong | G09G 3/3233 |
| 2022/0415234 | A1* | 12/2022 | Bhattacharjee | G09G 5/026 |

* cited by examiner

DRIVING CHIP AND DISPLAY DEVICE INCLUDING THE SAME

This application claims priority to Korean Patent Application No. 10-2021-0066907, filed on May 25, 2021, and all the benefits accruing therefrom under 35 U.S.C. § 119, the content of which in its entirety is herein incorporated by reference.

BACKGROUND

1. Field

Embodiments relate to a driving chip. More particularly, embodiments relate to a driving chip applied to a display device and a display device including the driving chip.

2. Description of the Related Art

A display device may include a plurality of pixels, a data driver providing a data signal to the pixels, and a scan driver providing a scan signal to the pixels. The pixels may display an image based on the data signal and the scan signal.

Each of the data driver and the scan driver may be formed on a display panel including the pixels, or may be implemented as a driving chip. The data driver may be implemented as a data driving chip, and the scan driver may be implemented as a scan driving chip separate from the data driving chip, for example.

SUMMARY

Embodiments provide a driving chip in which interference between a data signal and a scan signal is reduced or substantially prevented.

Embodiments provide a display device in which a dead space is reduced.

A driving chip in an embodiment includes a data channel block including a plurality of data channels, a scan channel block disposed in a first direction from the data channel block and including a plurality of scan channels, a data pad block disposed outside the data channel block and the scan channel block in the first direction and including a plurality of data pads which respectively receive data signals from the plurality of data channels, and a scan pad block disposed outside the data channel block and the scan channel block in the first direction, disposed outside the data pad block in a second direction crossing the first direction and including a plurality of scan pads which respectively receive scan signals from the scan channels.

In an embodiment, the data channel block may be disposed outside the scan channel block in the first direction.

In an embodiment, each of the plurality of data channels may extend in the first direction, and each of the scan channels may extend in the first direction.

In an embodiment, each of the plurality of data channels may extend in the first direction, and each of the scan channels may extend in the second direction.

In an embodiment, the data channel block may be disposed inside the scan channel block in the first direction.

In an embodiment, each of the plurality of data channels may extend in the first direction, and each of the scan channels may extend in the first direction.

In an embodiment, each of the plurality of data channels may extend in the first direction, and each of the scan channels may extend in the second direction.

In an embodiment, each of the plurality of data channels may include a first shift register which generates a sampling signal based on a data clock signal, a latch which stores an image data in response to the sampling signal, a first level shifter which shifts a voltage level of a latch output signal outputted from the latch, a digital-analog converter which performs a digital-analog conversion on a shifter output signal outputted from the first level shifter, and a first output buffer which outputs a data signal of the data signals outputted from the digital-analog converter.

In an embodiment, each of the scan channels may include a second shift register which generates a scan signal of the scan signals based on a scan clock signal, a second level shifter which shifts a voltage level of the scan signal outputted from the second shift register, and a second output buffer which outputs the scan signal outputted from the second level shifter.

In an embodiment, the driving chip may further include a global circuit disposed inside the data channel block and the scan channel block in the second direction and a plurality of input pads disposed inside the data pad block in the second direction.

A driving chip in an embodiment includes a plurality of data channel groups arranged in a first direction and each including a plurality of data channels arranged in the first direction, a plurality of scan channels alternately arranged with the data channel groups in the first direction, a plurality of data pads which are respectively disposed outside the plurality of data channels in a second direction crossing the first direction and respectively receive data signals from the plurality of data channels, and a plurality of scan pads which are respectively disposed outside the scan channels in the second direction and respectively receive scan signals from the scan channels.

In an embodiment, at least one of the plurality of data channels may be disposed between two of the scan channels which are adjacent in the first direction.

In an embodiment, each of the plurality of data channels may extend in the second direction, and each of the scan channels may extend in the second direction.

A driving chip in an embodiment includes a data channel block including a plurality of data channels, a scan channel block disposed outside the data channel block in a first direction and including a plurality of scan channels, a data pad block including a plurality of data pads which respectively receive data signals from the plurality of data channels, and a scan pad block including a plurality of scan pads which respectively receive scan signals from the scan channels. A distance between the scan pad block and the scan channel block may be less than a distance between the scan pad block and the data channel block.

In an embodiment, a distance between the data channel block and the data pad block may be less than a distance between the data channel block and the scan pad block.

In an embodiment, the data pad block may be disposed between the data channel block and the scan channel block in the first direction, and the scan channel block may be disposed between the data pad block and the scan pad block in the first direction.

In an embodiment, the scan channel block may be disposed between the data channel block and the data pad block in the first direction, and the data pad block may be disposed between the scan channel block and the scan pad block in the first direction.

In an embodiment, the data pad block may be disposed between the data channel block and the scan pad block in the first direction, and the scan pad block may be disposed between the data pad block and the scan channel block in the first direction.

In an embodiment, the data channel block may further include at least one dummy channel, and the scan pad block may further include at least one dummy pad electrically connected to the dummy channel.

In an embodiment, the data pad block may further include at least one sensing pad which receives a sensing signal.

A display device in an embodiment includes a display panel including a plurality of pixels, a plurality of scan lines extending in a first extension direction and connected to the pixels, and a plurality of data lines extending in a second extension direction crossing the first extension direction and connected to the pixels, and a driving chip which provides data signals to the data lines and which provides scan signals to the scan lines. The driving chip may include a plurality of data channels, a plurality of scan channels disposed in a first direction from the plurality of data channels, a plurality of data pads which are disposed outside the plurality of data channels and the scan channels in the first direction, respectively receive data signals from the plurality of data channels and respectively provide the data signals to the data lines, and a plurality of scan pads which disposed outside the plurality of data channels and the scan channels in the first direction, disposed outside the data pads in a second direction crossing the first direction, respectively receive scan signals from the scan channels and respectively provide the scan signals to the scan lines.

In an embodiment, the second direction is the same as the first extension direction.

In an embodiment, the second direction is the same as the second extension direction.

The driving chip in the embodiments may include the plurality of data channels, the scan channels, the data pads, and the scan pads disposed in various manners, so that the data driver and the scan driver may be implemented in one driving chip, and interference between the data signal and the scan signal may be reduced or substantially prevented.

The display device in the embodiments may include the driving chip which includes the data driver and the scan driver, so that a dead space of the display device may be reduced.

BRIEF DESCRIPTION OF THE DRAWINGS

Illustrative, non-limiting embodiments will be more clearly understood from the following detailed description taken in conjunction with the accompanying drawings.

DETAILED DESCRIPTION

Figure 1A:
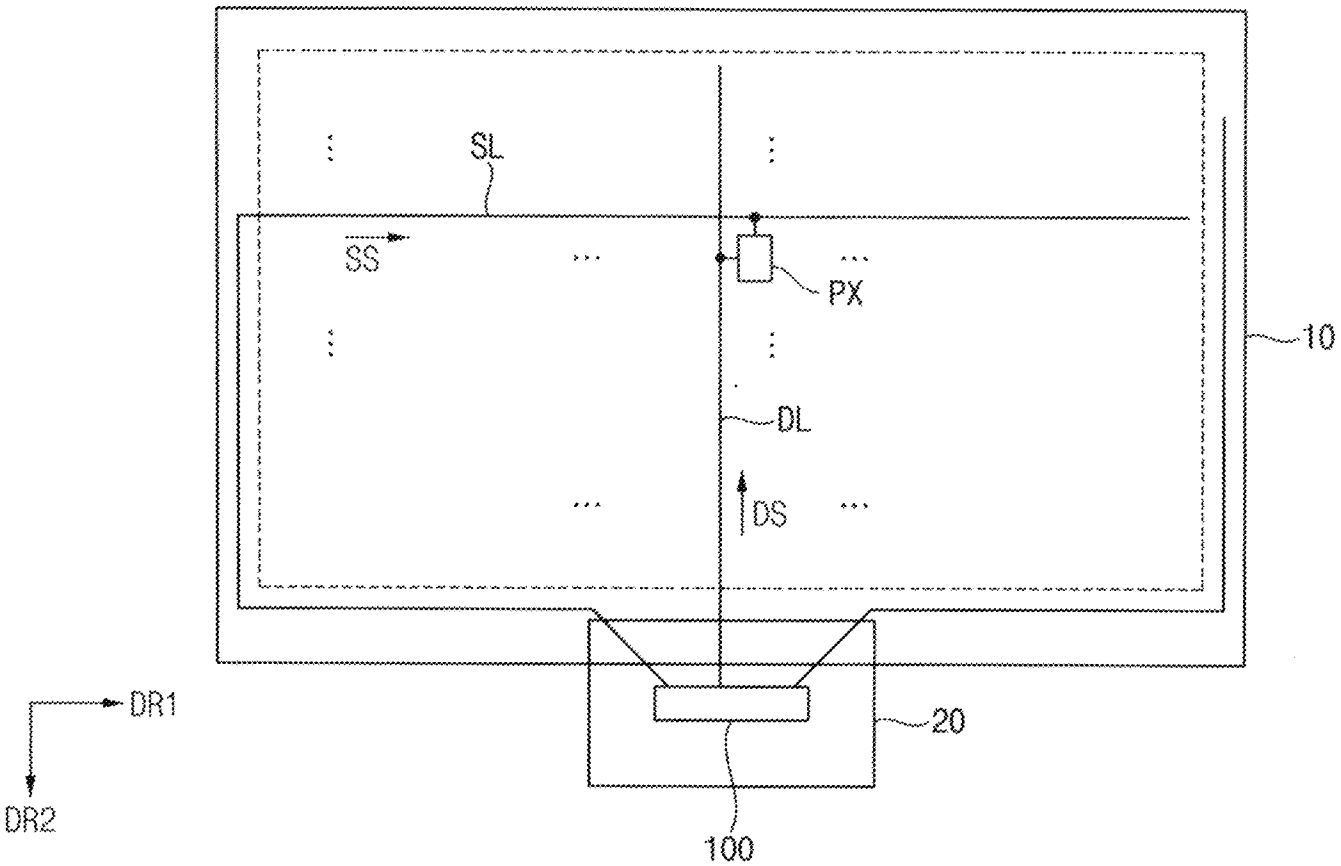
FIG. 1A is a diagram illustrating an embodiment of a display device.

Hereinafter, driving chips and display devices in embodiments will be explained in detail with reference to the accompanying drawings.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper,"

depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). The term "about" can mean within one or more standard deviations, or within ±30%, 20%, 10%, 5% of the stated value, for example.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Figure 1B:
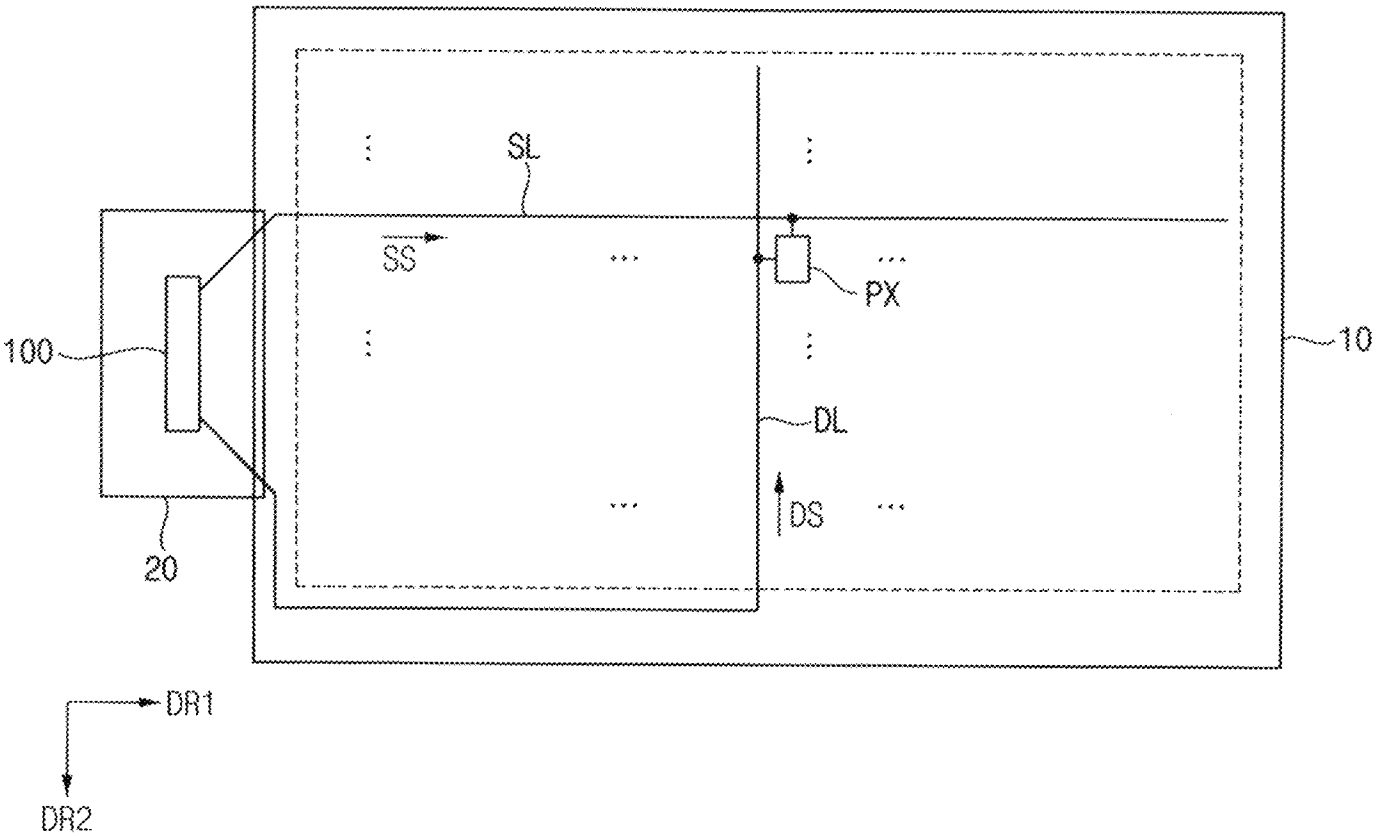
FIG. 1B is a diagram illustrating an embodiment of a display device.
Figure 2A:
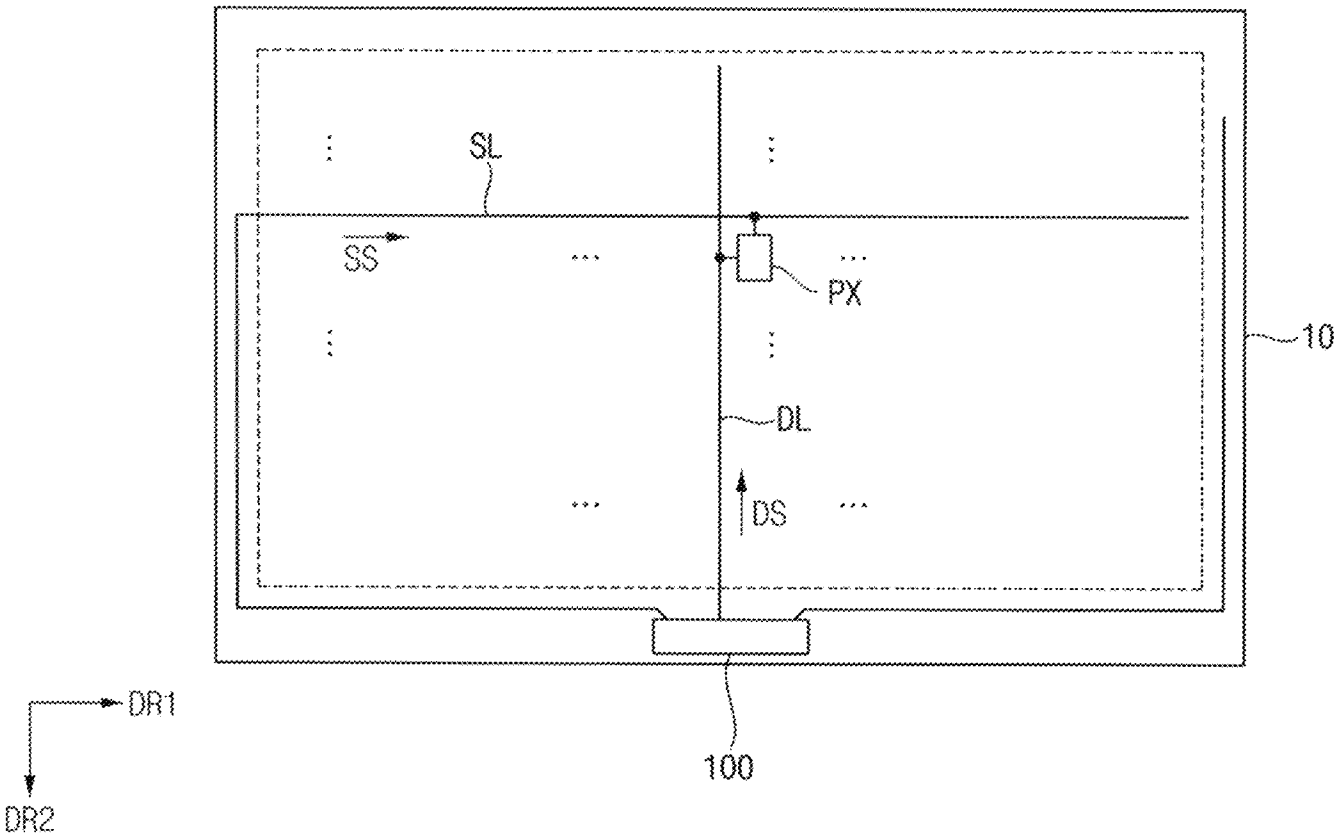
FIG. 2A is a diagram illustrating an embodiment of a display device.
Figure 2B:
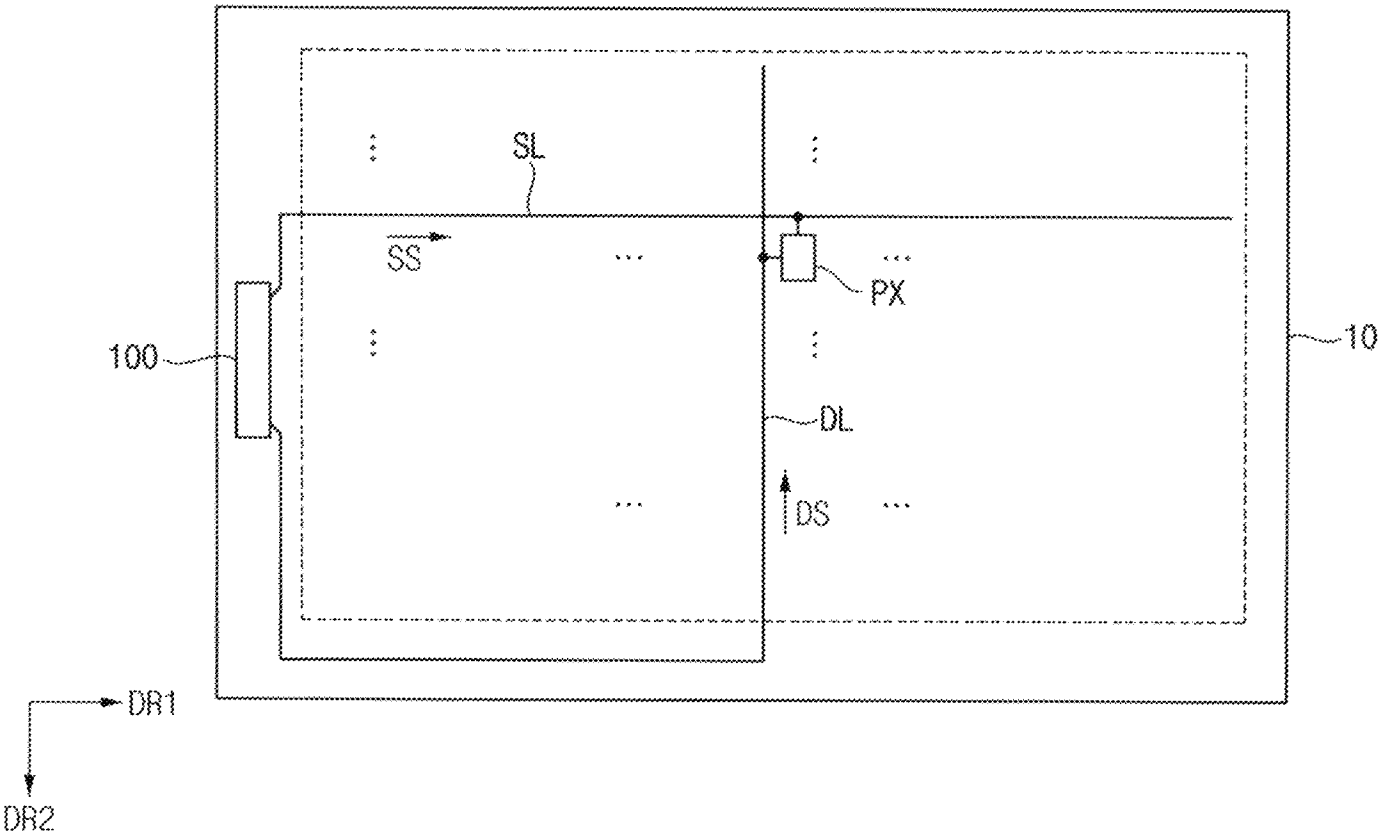
FIG. 2B is a diagram illustrating an embodiment of a display device.

FIG. 1A is a diagram illustrating an embodiment of a display device. FIG. 1B is a diagram illustrating an embodiment of a display device. FIG. 2A is a diagram illustrating an embodiment of a display device. FIG. 2B is a diagram illustrating a display device.

Referring to FIGS. 1A, 1B, 2A, and 2B, a display device may include a display panel 10 and a driving chip 100. The display panel 10 may include a plurality of pixels PX, a plurality of data lines DL, and a plurality of scan lines SL.

The pixels PX may be arranged in a first direction DR1 and a second direction DR2 crossing the first direction DR1. In an embodiment, the second direction DR2 may be substantially perpendicular to the first direction DR1. Each of the pixels PX may emit light, and the display device may display an image based on the light emitted from the pixels PX.

The data lines DL may extend in the second direction DR2, and may be arranged in the first direction DR1. The data lines DL may be connected to the pixels PX, and may provide a data signal DS to the pixels PX.

The scan lines SL may extend in the first direction DR1, and may be arranged in the second direction DR2. The scan lines SL may be connected to the pixels PX, and may provide a scan signal SS to the pixels PX.

The driving chip 100 may include a data driver and a scan driver. In other words, the data driver and the scan driver may be implemented as an integrated driving chip 100.

The driving chip 100 may be connected to the data lines DL and the scan lines SL. The data driver may provide the data signal DS to the data lines DL, and the scan driver may provide the scan signal SS to the scan lines SL.

In an embodiment, as shown in FIGS. 1A and 1B, a driving film 20 may be connected to the display panel 10, and the driving chip 100 may be connected to the display panel 10 through the driving film 20 in a chip on film ("COF") manner. In another embodiment, as shown in FIGS. 2A and 2B, the driving chip 100 may be disposed (e.g., mounted) on the display panel 10 in a chip on glass ("COG") manner or a chip on plastic ("COP") manner.

In an embodiment, as shown in FIGS. 1A and 2A, the driving chip 100 may be disposed adjacent to a side (e.g., a lower side) of the display panel 10 which extends in the first direction DR1 (e.g., a long side of the display panel 10). In another embodiment, as shown in FIGS. 1B and 2B, the driving chip 100 may be disposed adjacent to a side (e.g., a left side) of the display panel 10 which extends in the second direction DR2 (e.g., a short side of the display panel 10).

FIGS. 1A, 1B, 2A, and 2B illustrate that the display device includes one driving chip 100, however, the invention is not limited thereto, and the display device may include a plurality of driving chips.

Figure 3:
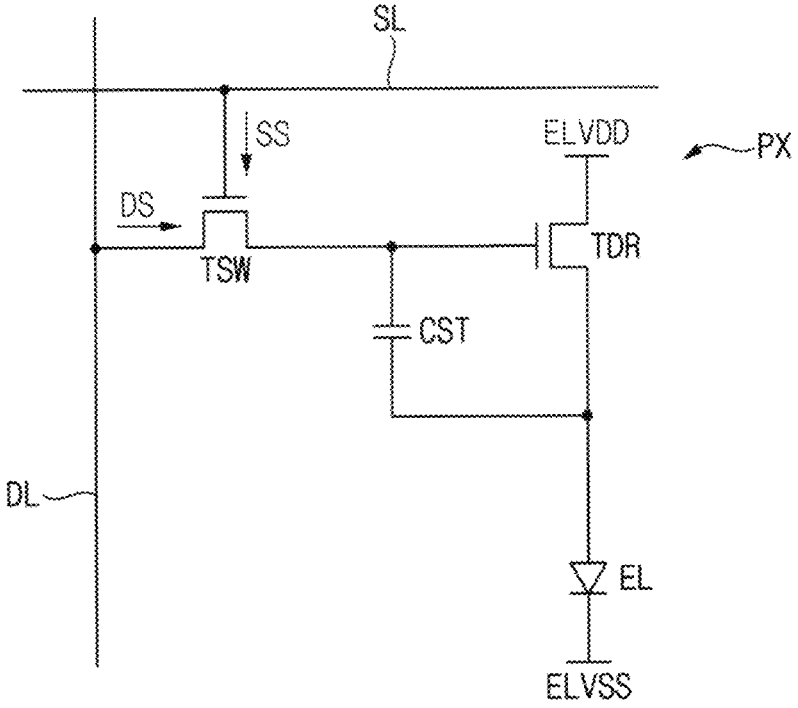
FIG. 3 is a circuit diagram illustrating an embodiment of a pixel included in a display device.

FIG. 3 is a circuit diagram illustrating an embodiment of a pixel PX included in a display device.

Referring to FIG. 3, a pixel PX may include a driving transistor TDR, a switching transistor TSW, a storage capacitor CST, and a light-emitting element EL.

The storage capacitor CST may store the data signal DS transmitted through the data line DL. In an embodiment, the storage capacitor CST may include a first electrode connected to a gate of the driving transistor TDR and a second electrode connected to a source of the driving transistor TDR.

The switching transistor TSW may transmit the data signal DS to the first electrode of the storage capacitor CST in response to the scan signal SS transmitted through the scan line SL. In an embodiment, the switching transistor TSW may include a gate connected to the scan line SL, a drain connected to the data line DL, and a source connected to the first electrode of the storage capacitor CST and the gate of the driving transistor TDR.

The driving transistor TDR may generate a driving current based on the data signal DS stored in the storage capacitor CST. In an embodiment, the driving transistor TDR may include the gate connected to the first electrode of the storage capacitor CST, a drain receiving a first power voltage ELVDD (e.g., a high power voltage), and the source connected to the second electrode of the storage capacitor CST.

The light-emitting element EL may emit light in response to the driving current generated by the driving transistor TDR. In an embodiment, the light-emitting element EL may be an organic light-emitting diode. In this case, the light-emitting element EL may include an anode connected to the source of the driving transistor TDR and a cathode receiving a second power voltage ELVSS (e.g., a low power voltage).

In another embodiment, the light-emitting element EL may be a liquid crystal capacitor. However, the light-emitting element EL is not limited to the organic light-emitting diode and the liquid crystal capacitor, and may be any light-emitting element.

FIG. 3 illustrates that the pixel PX includes two transistors and one capacitor, however, the invention is not limited thereto, and the pixel PX may include three or more transistors and/or two or more capacitors.

Figure 4:
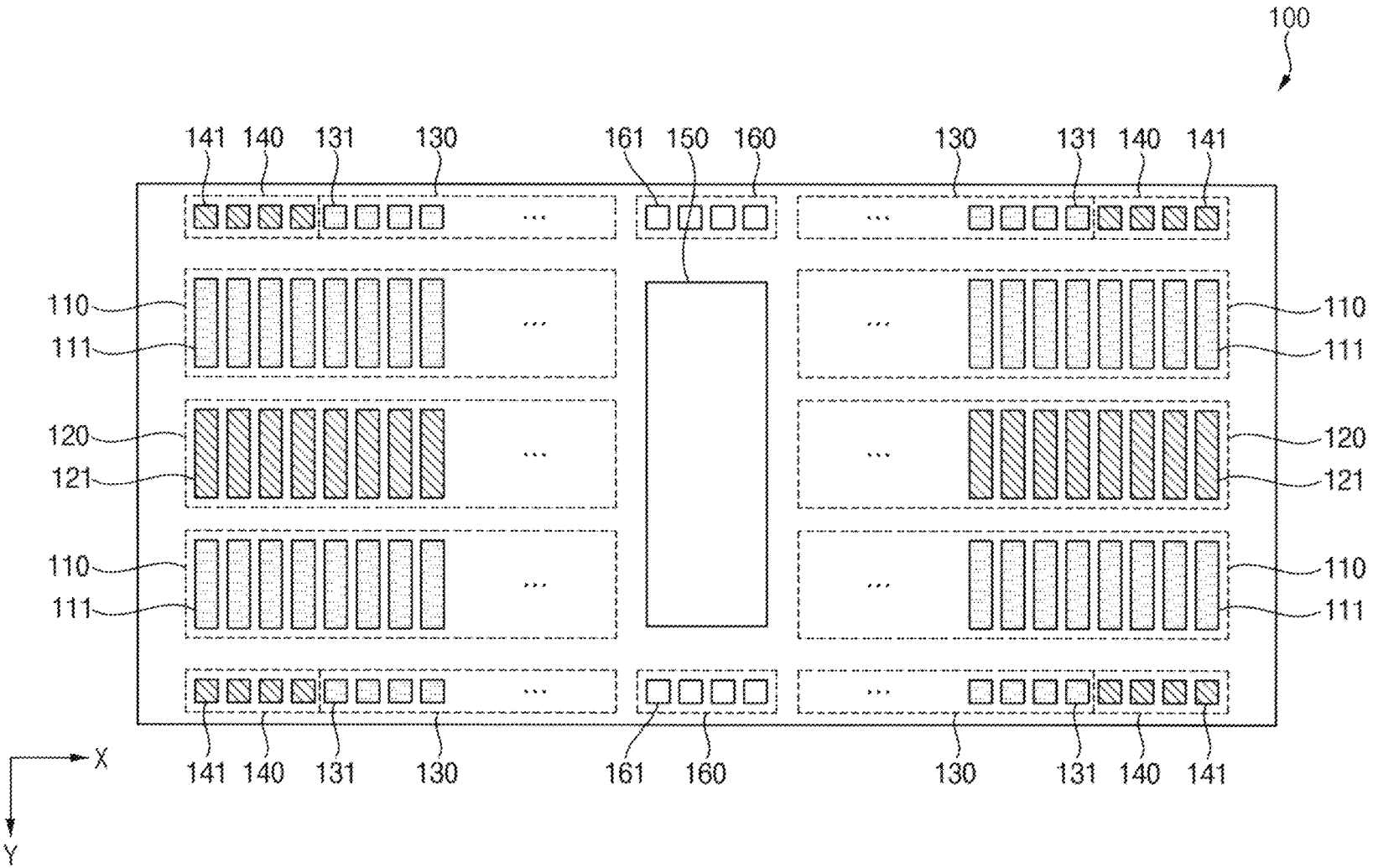
FIG. 4 is a diagram illustrating an embodiment of a driving chip.

FIG. 4 is a diagram illustrating an embodiment of a driving chip 100.

Referring to FIG. 4, the driving chip 100 may include a data channel block 110, a scan channel block 120, a data pad block 130, a scan pad block 140, a global circuit 150, and an input pad block 160.

The data channel block 110 may include a plurality of data channels 111. The data channels 111 may be arranged in an X-axis direction. Each of the data channels 111 may generate the data signal DS.

The scan channel block 120 may include a plurality of scan channels 121. The scan channels 121 may be arranged in the X-axis direction. Each of the scan channels 121 may generate the scan signal SS. The scan channel block 120 may be disposed in a Y-axis direction from the data channel block 110.

The data channel block 110 may be disposed outside the scan channel block 120 in the Y-axis direction. Specifically, the data channel block 110 may be disposed outside the scan channel block 120 in a +Y-axis direction and a −Y-axis direction. In an embodiment, the scan channel block 120 may be disposed at a center portion in the Y-axis direction in the driving chip 100, and the data channel block 110 may be disposed outside the scan channel block 120 in the Y-axis direction in the driving chip 100. In an embodiment, a center of the scan channel block 120 in the Y-axis direction may correspond to a center of the driving chip 100 in the Y-axis direction, but the invention is not limited thereto.

Each of the data channels 111 may extend in the Y-axis direction, and each of the scan channels 121 may extend in the Y-axis direction. In other words, a length of the data channel 111 in the Y-axis direction may be greater than a length of the data channel 111 in the X-axis direction, and a length of the scan channel 121 in the Y-axis direction may be greater than a length of the scan channel 121 in the X-axis direction.

The data pad block 130 may include a plurality of data pads 131. The data pads 131 may be arranged in the X-axis direction. The data pads 131 may respectively receive the data signals DS from the data channels 111. The data pads 131 may be electrically connected to pads formed or disposed on the driving film 20 (refer to FIGS. 1A and 1B), or the display panel 10. In an embodiment, the data pads 131 may be electrically connected to the pads formed or disposed on the driving film 20 through an anisotropic conductive film ("ACF").

The data pad block 130 may be disposed outside the data channel block 110 and the scan channel block 120 in the Y-axis direction. Specifically, the data pad block 130 may be disposed outside the data channel block 110 and the scan channel block 120 in the +Y-axis direction and the −Y-axis direction. In an embodiment, the data pad block 130 may be disposed at an edge portion in the Y-axis direction in the driving chip 100, and the data channel block 110 may be disposed between the scan channel block 120 and the data pad block 130 in the Y-axis direction in the driving chip 100. In an embodiment, the data pad block 130 may be spaced apart from an edge of the driving chip 100 in the Y-axis direction, but the inventions is not limited thereto.

The scan pad block 140 may include a plurality of scan pads 141. The scan pads 141 may be arranged in the X-axis direction. The scan pads 141 may respectively receive the scan signals SS from the scan channels 121. The scan pads 141 may be electrically connected to pads formed or disposed on the driving film 20 or the display panel 10. In an embodiment, the scan pads 141 may be electrically connected to the pads formed or disposed on the driving film 20 through an ACF.

The scan pad block 140 may be disposed outside the data channel block 110 and the scan channel block 120 in the Y-axis direction, and may be disposed outside the data pad block 130 in the X-axis direction. Specifically, the scan pad block 140 may be disposed outside the data channel block 110 and the scan channel block 120 in the +Y axis direction and the −Y axis direction, and may be disposed outside the data pad block 130 in a +X axis direction and a −X axis direction. In an embodiment, the scan pad block 140 may be disposed at an edge portion in the Y-axis direction in the driving chip 100, and may be disposed outside the data pad block 130 in the X-axis direction in the driving chip 100. In an embodiment, the scan pad block 140 may be spaced apart from an edge of the driving chip 100 in the Y-axis direction, but the invention is not limited thereto.

The data channels 111 and the data pads 131 may form the data driver. The scan channels 121 and the scan pads 141 may form the scan driver.

The global circuit 150 may be disposed inside the data channel block 110 and the scan channel block 120 in the X-axis direction. In an embodiment, the global circuit 150 may be disposed at a center portion in the X-axis direction and a center portion in the Y-axis direction in the driving chip 100. In an embodiment, a center of the global circuit 150 in the X-axis direction and the Y-axis direction may correspond to a center of the driving chip 100 in the X-axis direction and the Y-axis direction, but the invention is not limited thereto. The global circuit 150 may include an analog front end ("AFE"), an analog-digital converter ("ADC"), a bias controller, a gamma voltage generator, an interface, or the like.

The input pad block 160 may include a plurality of input pads 161 and at least one power pad. The input pads 161 and the power pad may be arranged in the X-axis direction. The input pads 161 may receive a data control signal for generating the data signal DS, a scan control signal for generating the scan signal SS, or the like. The input pad block 160 may be disposed inside the data pad block 130 in the X-axis direction. In an embodiment, the input pad block 160 may be disposed at a center portion in the X-axis direction and an edge portion in the Y-axis direction in the driving chip 100. In an embodiment, a center of the input pad block 160 in the X-axis may correspond to a center of the driving chip 100 in the X-axis, but the invention is not limited thereto. In an embodiment, the input pad block 160 may be space apart from an edge of the driving chip 100 in the Y-axis direction, but the invention is not limited thereto.

In an embodiment, as shown in FIGS. 1A and 2A, the X-axis direction and the Y-axis direction may be the same as the first direction DR1 and the second direction DR2, respectively. In another embodiment, as shown in FIGS. 1B and 2B, the X-axis direction and the Y-axis direction may be the same as the second direction DR2 and the first direction DR1, respectively.

Figure 5:
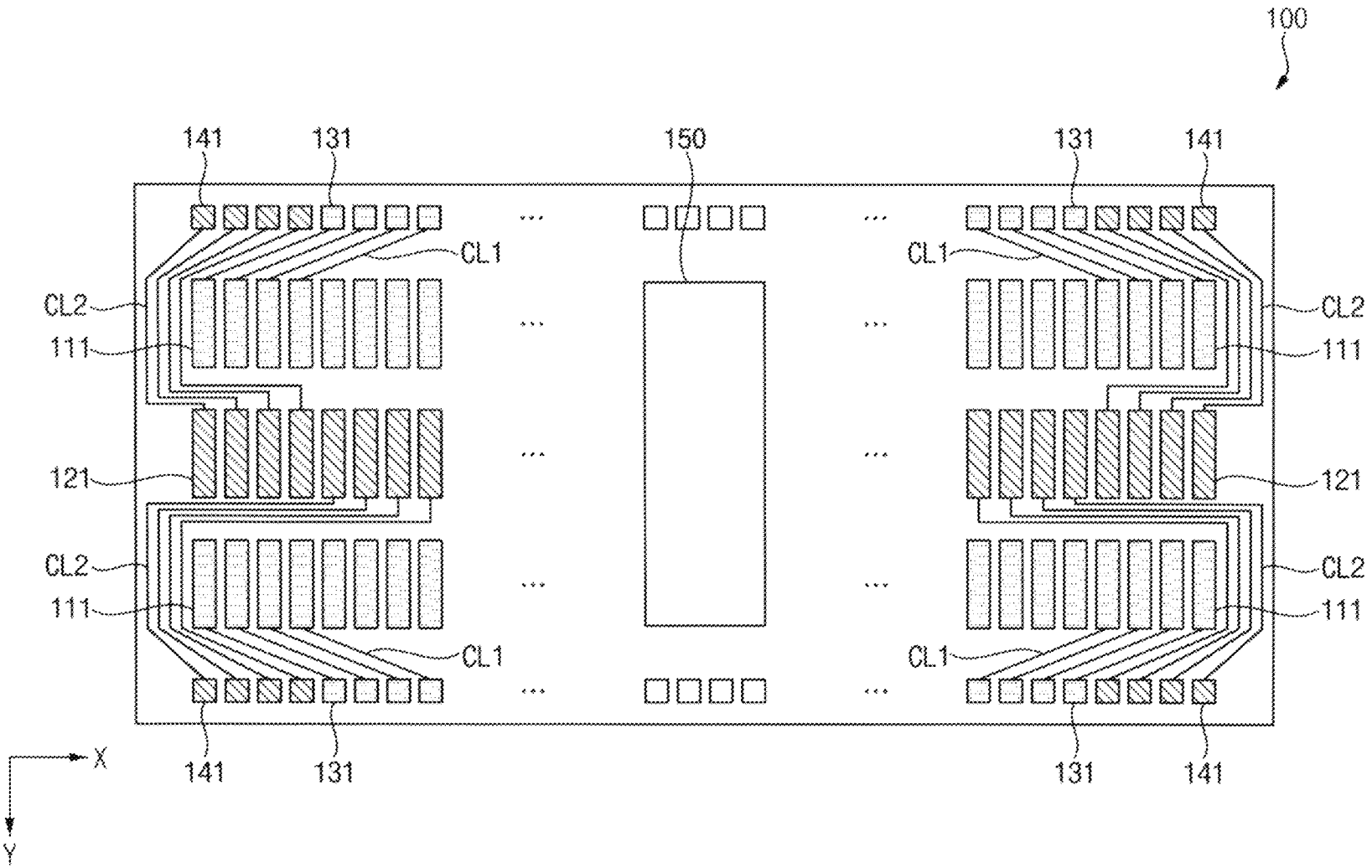
FIG. 5 is a diagram illustrating an embodiment in which a data channel and a scan channel are connected to a data pad and a scan pad, respectively.

FIG. 5 is a diagram illustrating an embodiment in which the data channel 111 and the scan channel 121 are connected to the data pad 131 and the scan pad 141, respectively.

Referring to FIGS. 4 and 5, the data channels 111 may be respectively connected to the data pads 131 through the first connection lines CL1. The first connection line CL1 may extend from the data channel 111 to the data pad 131 connected thereto, and may transmit the data signal DS from the data channel 111 to the data pad 131 connected thereto.

The scan channels 121 may be respectively connected to the scan pads 141 through the second connection lines CL2. The second connection line CL2 may bypass the data channel block 110 and extend from the scan channel 121 to the scan pad 141 connected thereto, and may transmit the scan signal SS from the scan channel 121 to the scan pad 141 connected thereto.

In the driving chip 100 in an embodiment, the data channel block 110, the scan channel block 120, the data pad block 130, and the scan pad block 140 may be disposed as shown in FIGS. 4 and 5, so that electrical connection or influence between the first connection lines CL1 and the second connection lines CL2 may be reduced. Accordingly, interference between the data signal DS and the scan signal SS may be reduced or substantially prevented.

Figure 6:
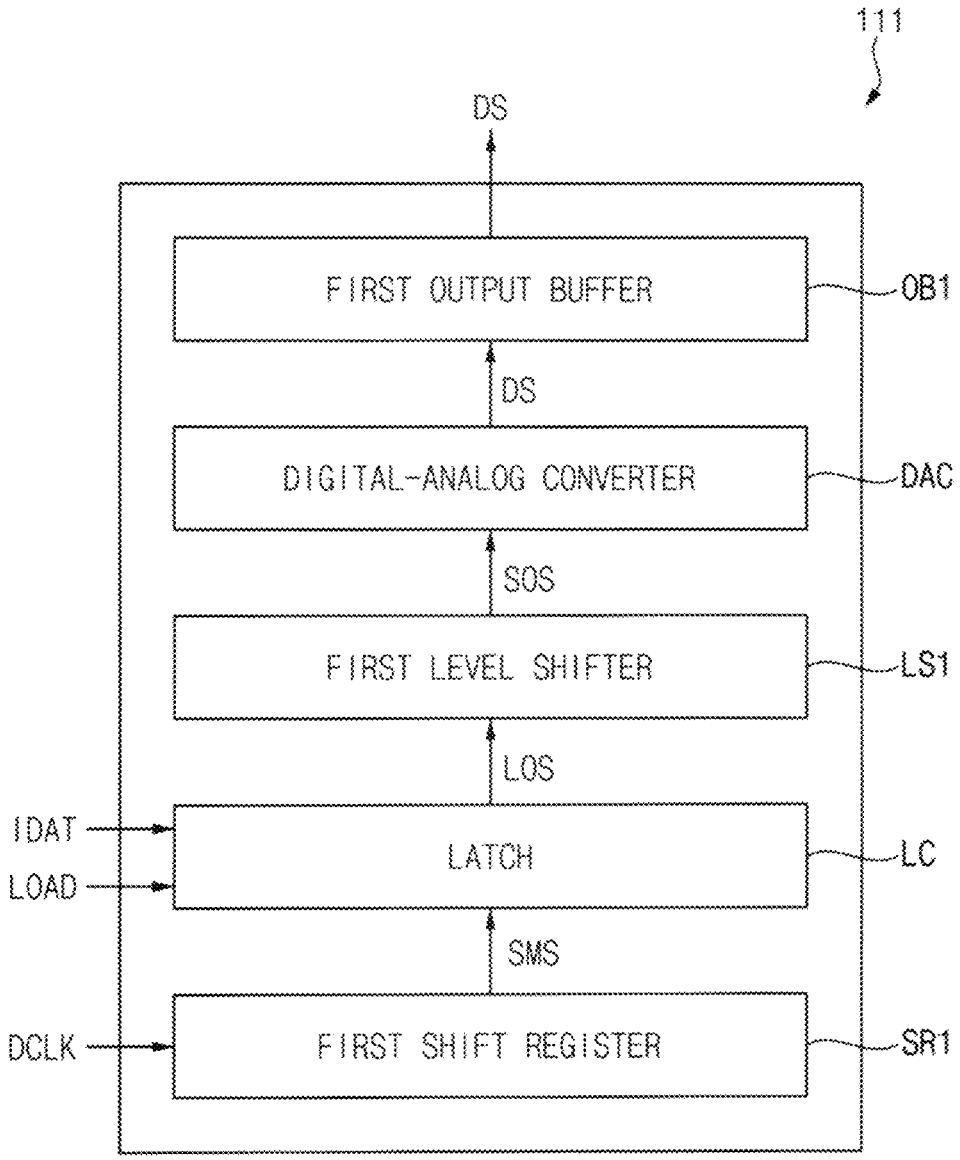
FIG. 6 is a block diagram illustrating an embodiment of a data channel in FIG. 4.

FIG. 6 is a block diagram illustrating the data channel 111 in FIG. 4.

Referring to FIG. 6, the data channel 111 may include a first shift register SR1, a latch LC, a first level shifter LS1, a digital-analog converter DAC, and a first output buffer OB1.

The first shift register SR1 may generate a sampling signal SMS based on a data clock signal DCLK. In an embodiment, the first shift register SR1 may include a plurality of flip-flops generating the sampling signal SMS.

The latch LC may store image data IDAT in response to the sampling signal SMS, and may output the image data IDAT or a latch output signal LOS for the pixel PX in response to a load signal LOAD. In an embodiment, the latch LC may include a sampling latch for storing the image data IDAT in response to the sampling signal SMS and/or a holding latch for storing and outputting the image data IDAT for the pixel PX stored in the sampling latch in response to the load signal LOAD.

The first level shifter LS1 may shift a voltage level of the latch output signal LOS outputted from the latch LC. In an embodiment, the first level shifter LS1 may shift the voltage level of the latch output signal LOS to a voltage level suitable for the digital-analog converter DAC, for example.

The digital-analog converter DAC may perform a digital-analog conversion on a shifter output signal SOS outputted from the first level shifter LS1.

The first output buffer OB1 may output the data signal DS outputted from the digital-analog converter DAC. The first output buffer OB1 may serve to buffer the data signal DS.

Figure 7:
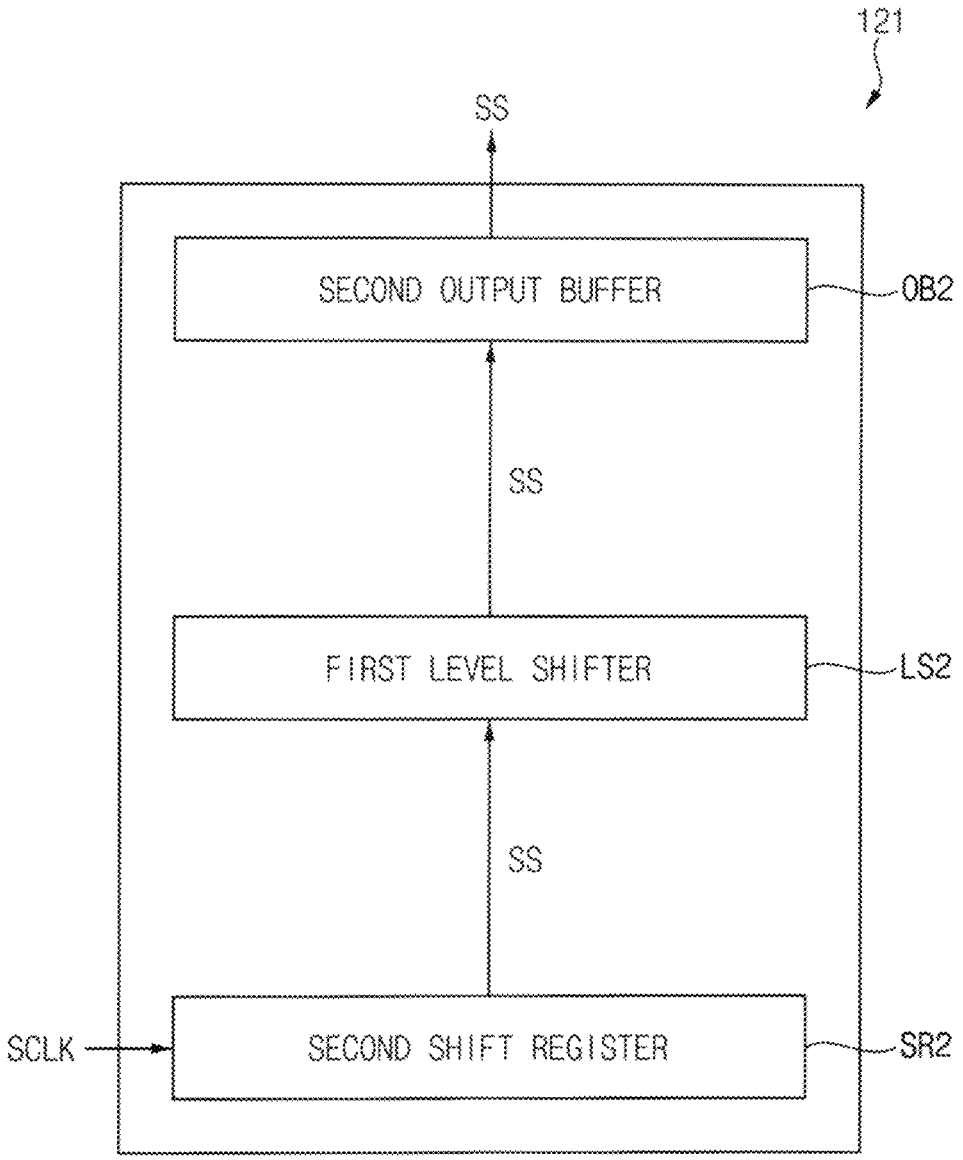
FIG. 7 is a block diagram illustrating an embodiment of a scan channel in FIG. 4.

FIG. 7 is a block diagram illustrating the scan channel 121 in FIG. 4.

Referring to FIG. 7, the scan channel 121 may include a second shift register SR2, a second level shifter LS2, and a second output buffer OB2.

The second shift register SR2 may generate the scan signal SS based on a scan clock signal SCLK.

The second level shifter LS2 may shift a voltage level of the scan signal SS outputted from the second shift register SR2. In an embodiment, the second level shifter LS2 may shift the voltage level of the scan signal SS to a voltage level suitable for the switching transistor TSW of the pixel PX, for example.

The second output buffer OB2 may output the scan signal SS outputted from the second level shifter LS2. The second output buffer OB2 may serve to buffer the scan signal SS.

In a display device according to the prior art, a data driving chip including data channels and data pads and a scan driving chip including scan channels and scan pads may be disposed (e.g., mounted) on or connected to a display panel. Accordingly, a dead space of the display device according to the prior art may increase.

However, in the display device in an embodiment, the driving chip 100 including the data channels 111, the scan channels 121, the data pads 131, and the scan pads 141 may be disposed (e.g., mounted) or connected to the display panel 10. Accordingly, a dead space of the display device in the embodiment may be reduced.

Figure 8:
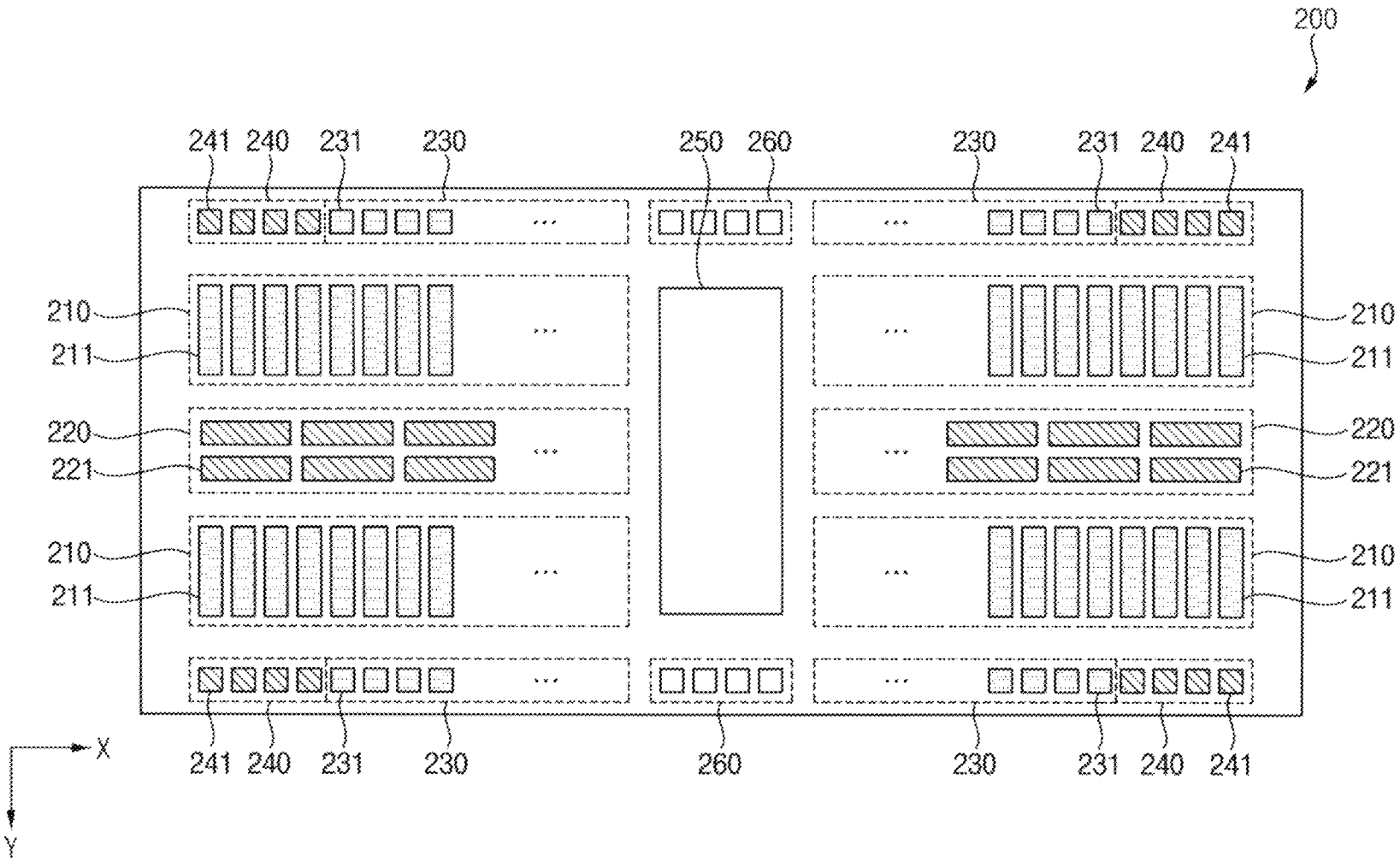
FIG. 8 is a diagram illustrating an embodiment of a driving chip.

FIG. 8 is a diagram illustrating an embodiment of a driving chip 200.

Referring to FIG. 8, a driving chip 200 may include a data channel block 210, a scan channel block 220, a data pad block 230, a scan pad block 240, a global circuit 250, and an input pad block 260. The data channel block 210 may include a plurality of data channels 211, and the scan channel block 220 may include a plurality of scan channels 221. The data pad block 230 may include a plurality of data pads 231, and the scan pad block 240 may include a plurality of scan pads 241. The driving chip 200 described with reference to FIG. 8 may be substantially the same as or similar to the driving chip 100 described with reference to FIG. 4 except for extending directions of the scan channels 221. Accordingly, descriptions of the overlapping components will be omitted.

Each of the data channels 211 may extend in the Y-axis direction, and each of the scan channels 221 may extend in the X-axis direction. In other words, a length of the data channel 211 in the Y-axis direction may be greater than a length of the data channel 211 in the X-axis direction, and a length of the scan channel 221 in the Y-axis direction may be less than a length of the scan channel 221 in the X-axis direction. As each of the scan channels 221 extends in the X-axis direction, a length of the driving chip 200 in the Y-axis direction may decrease.

Figure 9:
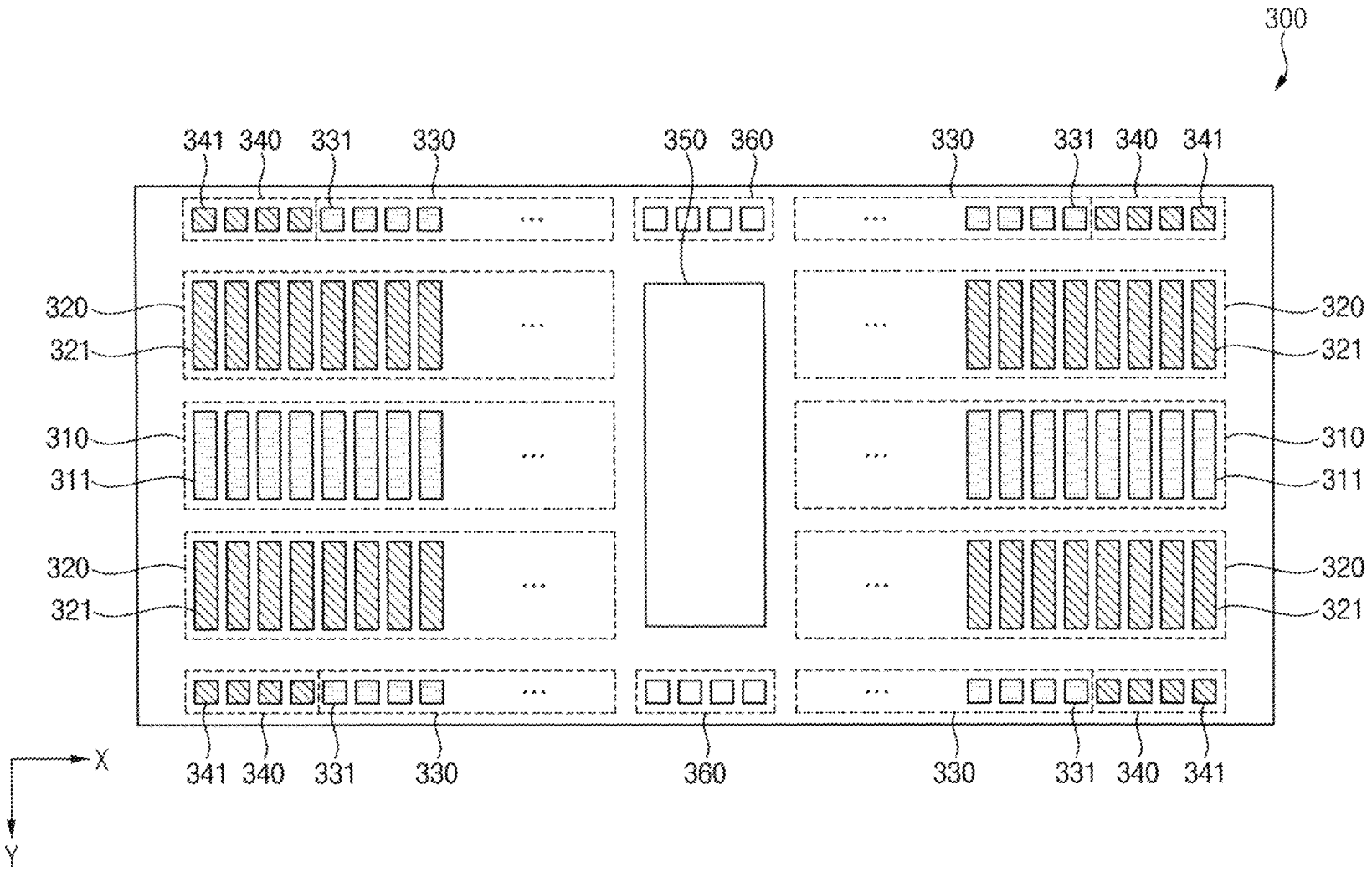
FIG. 9 is a diagram illustrating an embodiment of a driving chip.

FIG. 9 is a diagram illustrating an embodiment of a driving chip 300.

Referring to FIG. 9, a driving chip 300 may include a data channel block 310, a scan channel block 320, a data pad block 330, a scan pad block 340, a global circuit 350, and an input pad block 360. The data channel block 310 may include a plurality of data channels 311, and the scan channel block 320 may include a plurality of scan channels 321. The data pad block 330 may include a plurality of data pads 331, and the scan pad block 340 may include a plurality of scan pads 341. The driving chip 300 described with reference to FIG. 9 may be substantially the same as or similar to the driving chip 100 described with reference to FIG. 4 except for positions of the data channel block 310 and the scan channel block 320. Accordingly, descriptions of the overlapping components will be omitted.

The data channel block 310 may be disposed inside the scan channel block 320 in the Y-axis direction. Specifically, the scan channel block 320 may be disposed outside the data channel block 310 in the +Y-axis direction and the −Y-axis direction. In an embodiment, the data channel block 310 may be disposed at a center portion in the Y-axis direction in the driving chip 300, and the scan channel block 320 may be disposed outside the data channel block 310 in the Y-axis direction in the driving chip 300. In an embodiment, a center of the data channel block 310 in the Y-axis direction may correspond to a center of the driving chip 300 in the Y-axis direction, but the invention is not limited thereto.

Each of the data channels 311 may extend in the Y-axis direction, and each of the scan channels 321 may extend in the Y-axis direction. In other words, a length of the data channel 311 in the Y-axis direction may be greater than a length of the data channel 311 in the X-axis direction, and a length of the scan channel 321 in the Y-axis direction may be greater than a length of the scan channel 321 in the X-axis direction.

In the driving chip 300 in an embodiment, the data channel block 310, the scan channel block 320, the data pad block 330, and the scan pad block 340 may be disposed as shown in FIG. 9. Accordingly, interference between the data signal DS and the scan signal SS may be reduced or substantially prevented.

Figure 10:
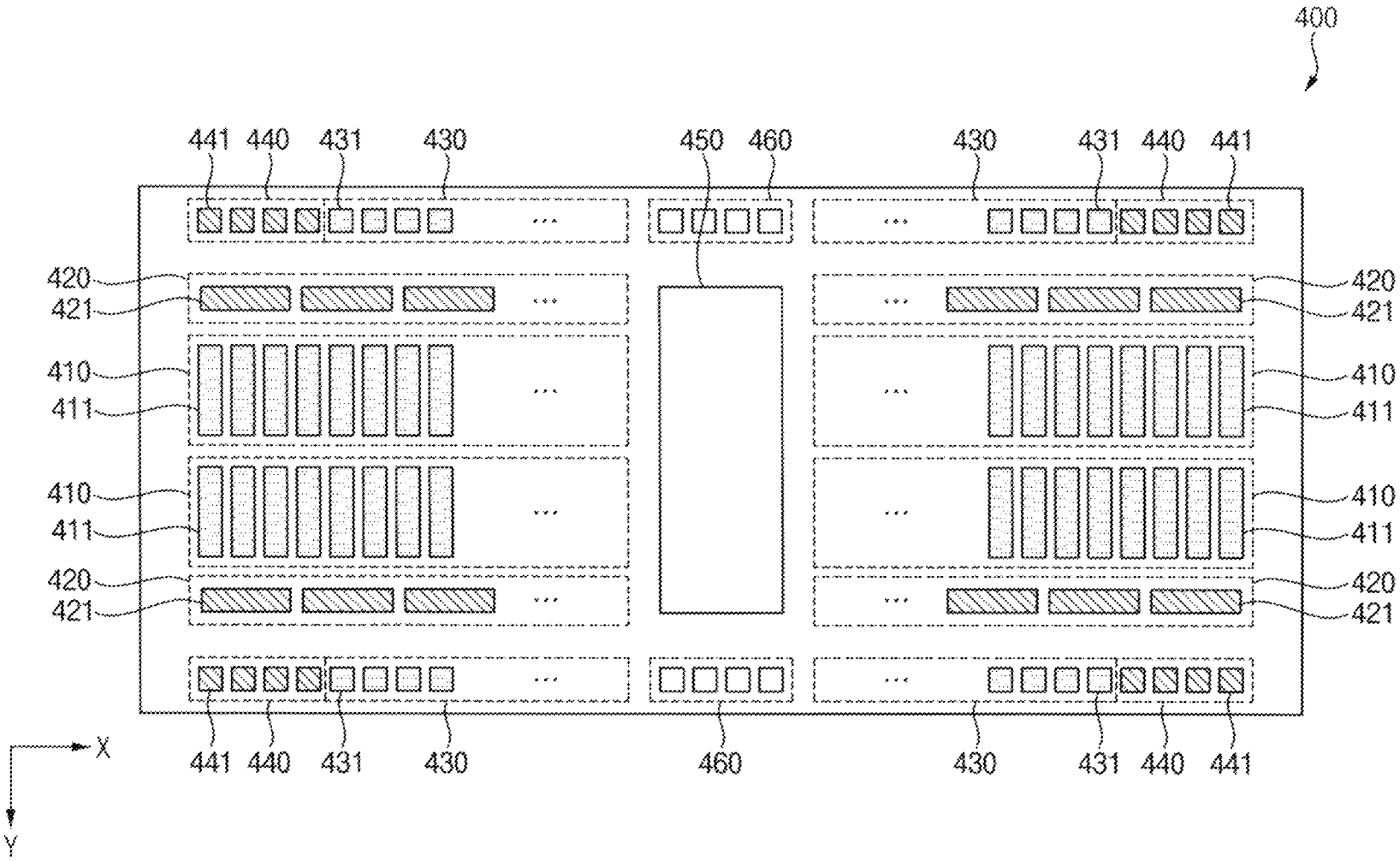
FIG. 10 is a diagram illustrating an embodiment of a driving chip.

FIG. 10 is a diagram illustrating an embodiment of a driving chip 400.

Referring to FIG. 10, a driving chip 400 may include a data channel block 410, a scan channel block 420, a data pad block 430, a scan pad block 440, a global circuit 450, and an input pad block 460. The data channel block 410 may include a plurality of data channels 411, and the scan channel block 420 may include a plurality of scan channels 421. The data pad block 430 may include a plurality of data pads 431, and the scan pad block 440 may include a plurality of scan pads 441. The driving chip 400 described with reference to FIG. 10 may be substantially the same as or similar to the driving chip 300 described with reference to FIG. 9 except for extending directions of the scan channels 421. Accordingly, descriptions of the overlapping components will be omitted.

Each of the data channels 411 may extend in the Y-axis direction, and each of the scan channels 421 may extend in the X-axis direction. In other words, a length the data channel 411 in the Y-axis direction of may be greater than a length of the data channel 411 in the X-axis direction, and a length of the scan channel 421 in the Y-axis direction may be less than a length of the scan channel 421 in the X-axis direction. As each of the scan channels 421 extends in the X-axis direction, a length of the driving chip 400 in the Y-axis direction may decrease.

Figure 11:
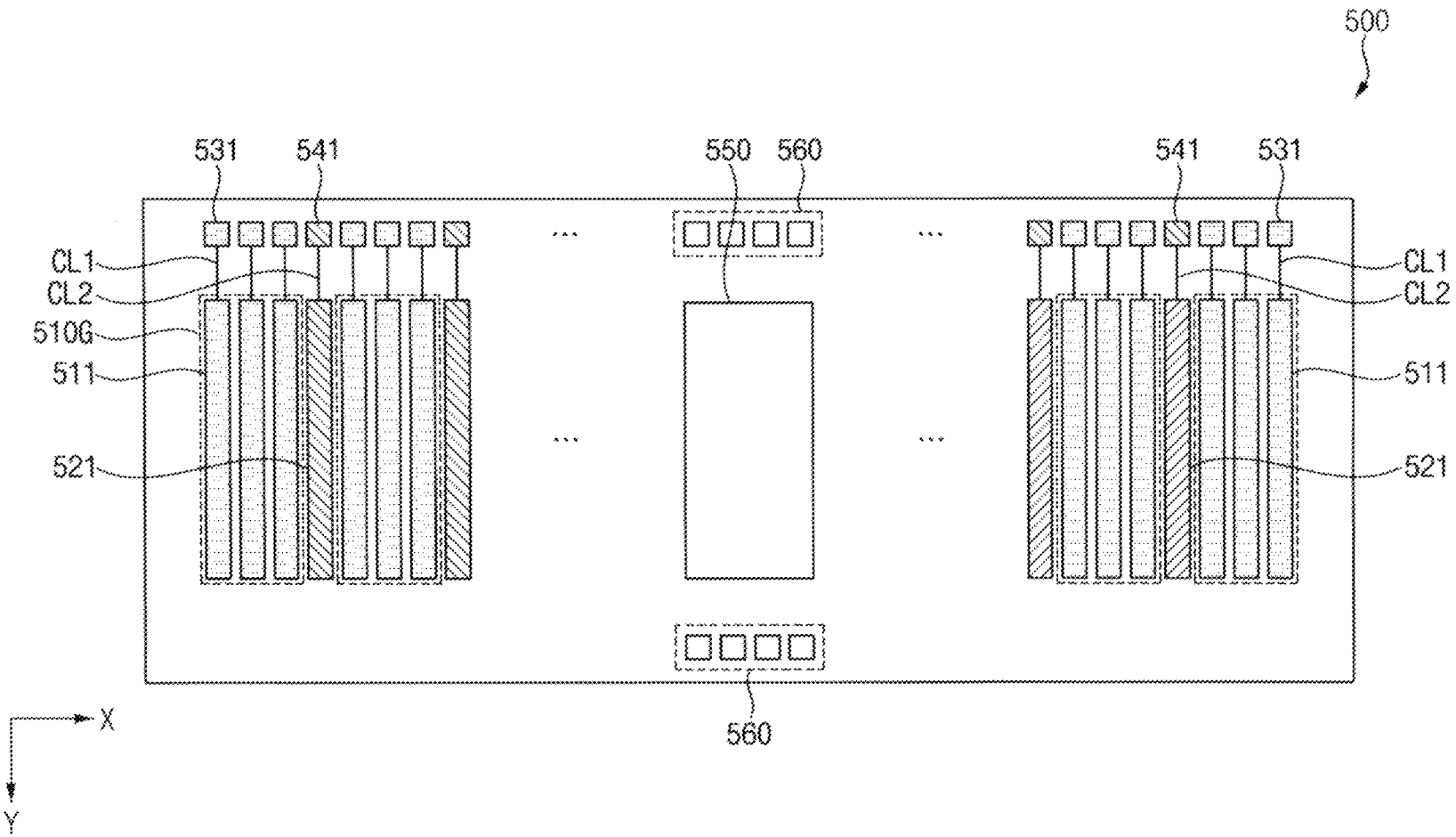
FIG. 11 is a diagram illustrating an embodiment of a driving chip.

FIG. 11 is a diagram illustrating an embodiment of a driving chip 500.

Referring to FIG. 11, a driving chip 500 may include a plurality of data channel groups 510G, a plurality of scan channels 521, a plurality of data pads 531, a plurality of scan pads 541, a global circuit 550, and an input pad block 560. Each of the data channel groups 510G may include a plurality of data channels 511. Descriptions of components of the driving chip 500 described with reference to FIG. 11, which are substantially the same as or similar to those of the driving chip 100 described with reference to FIG. 4, will be omitted.

The data channel groups 510G may be arranged in the X-axis direction. The data channels 511 included in each of the data channel groups 510G may be arranged in the X-axis direction. In an embodiment, each of the data channel groups 510G may include three data channels 511. However, the invention is not limited thereto, and in another embodiment, each of the data channel groups 510G may include two or four or more data channels 511.

The scan channels 521 may be alternately arranged with the data channel groups 510G in the X-axis direction. In other words, one scan channel 521 may be alternately arranged with a plurality of data channels 511 in the X-axis direction. At least one of the data channels 511 may be disposed between two adjacent scan channels 521 in the X-axis direction.

Each of the data channels 511 may extend in the Y-axis direction, and each of the scan channels 521 may extend in the Y-axis direction. In other words, a length of the data channel 511 in the Y-axis direction may be greater than a length of the data channel 511 in the X-axis direction, and a length of the scan channel 521 in the Y-axis direction may be greater than a length of the scan channel 521 in the X-axis direction.

The data pads 531 may be respectively disposed outside the data channels 511 in the Y-axis direction. Specifically, the data pads 531 may be respectively disposed outside the data channels 511 in the −Y-axis direction. In an embodiment, the data channels 511 may be disposed at a center portion in the Y-axis direction in the driving chip 500, and the data pads 531 may be respectively disposed outside the data channels 511 in the Y-axis direction in the driving chip 500. In an embodiment, a center of the scan channel block 511 in the Y-axis direction may correspond to a center of the driving chip 500 in the Y-axis direction, but the invention is not limited thereto.

The data pads 531 may be respectively connected to the data channels 511 through first connection lines CL1. The first connection lines CL1 may extend in the Y-axis direction. The data pads 531 may respectively receive the data signals DS from the data channels 511 through the first connection lines CL1.

The scan pads 541 may be respectively disposed outside the scan channels 521 in the Y-axis direction. Specifically, the scan pads 541 may be respectively disposed outside the scan channels 521 in the −Y-axis direction. In an embodiment, the scan channels 521 may be disposed at a center portion in the Y-axis direction in the driving chip 500, and the scan pads 541 may be respectively disposed outside the scan channels 521 in the Y-axis direction in the driving chip 500. In an embodiment, a center of the scan channels 521 in the Y-axis direction may correspond to a center of the driving chip 500 in the Y-axis direction, but the invention is not limited thereto.

In an embodiment, the scan pads 541 may be alternately arranged with data pad groups each including a plurality of data pads 531 in the X-axis direction. In other words, one scan pad 541 may be alternately arranged with a plurality of data pads 531 in the X-axis direction. At least one of the data pads 531 may be disposed between two adjacent scan pads 541 in the X-axis direction.

The scan pads 541 may be respectively connected to the scan channels 521 through second connection lines CL2. The second connection lines CL2 may extend in the Y-axis direction. The scan pads 541 may respectively receive the scan signals SS from the scan channels 521 through the second connection lines CL2.

In the driving chip 500 in an embodiment, the data channels 511, the scan channels 521, the data pads 531, and the scan pads 541 may be disposed as shown in FIG. 11. Accordingly, interference between the data signal DS and the scan signal SS may be reduced or substantially prevented.

Figure 12:
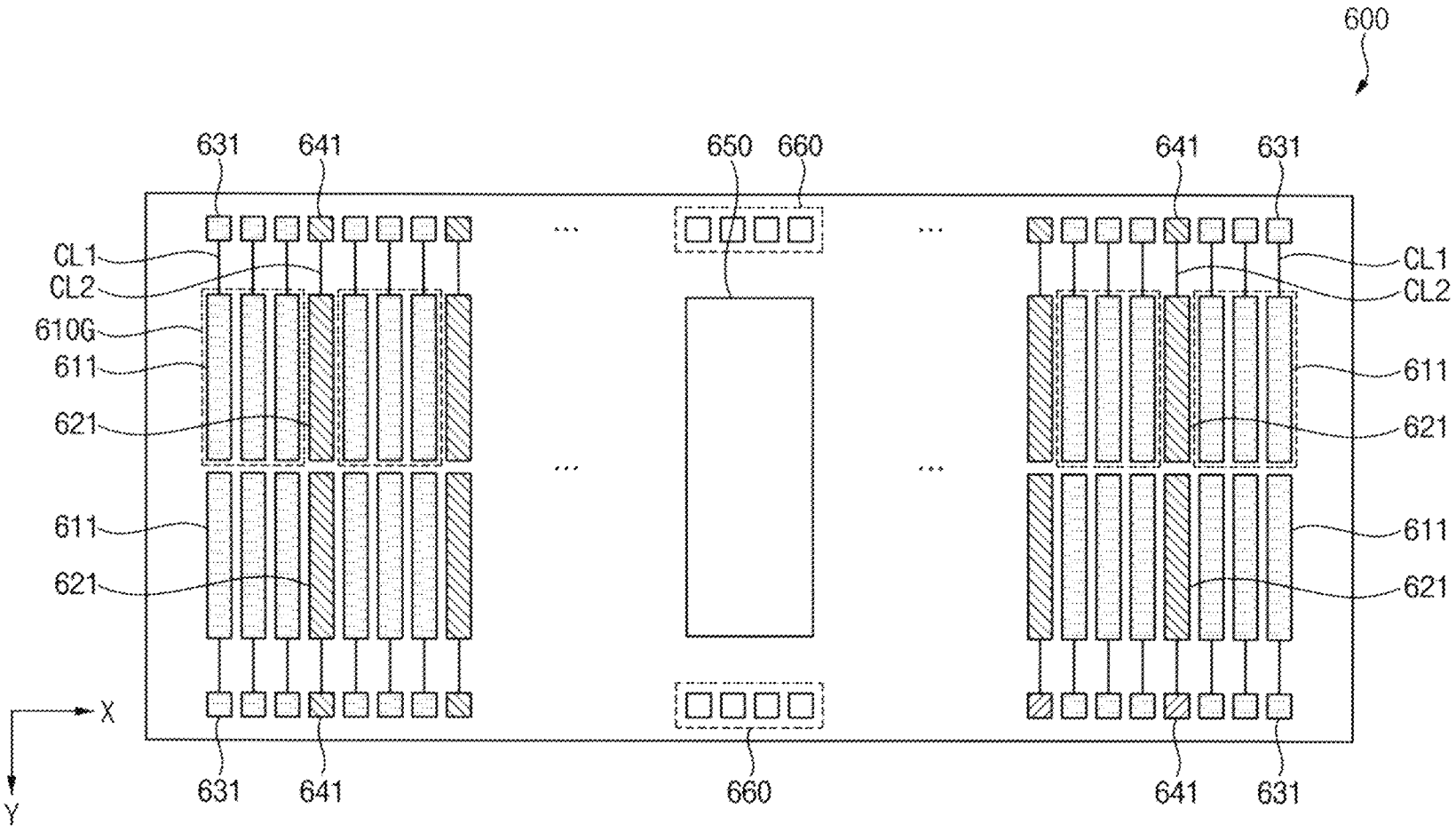
FIG. 12 is a diagram illustrating an embodiment of a driving chip.

FIG. 12 is a diagram illustrating an embodiment of a driving chip 600.

Referring to FIG. 12, a driving chip 600 may include a plurality of data channel groups 610G, a plurality of scan channels 621, a plurality of data pads 631, a plurality of scan pads 641, a global circuit 650, and an input pad block 660. Each of the data channel groups 610G may include a plurality of data channels 611. The driving chip 600 described with reference to FIG. 12 may be substantially the same as or similar to the driving chip 500 described with reference to FIG. 11 except for arrangements of the data channels 611, the scan channels 621, the data pads 631, and the scan pads 641. Accordingly, descriptions of the overlapping components will be omitted.

The data channel groups 610G may form two rows, and may be arranged in the X-axis direction. The scan channels 621 may form two rows, and may be alternately arranged with the data channel groups 610G in the X-axis direction.

The data pads 631 may be respectively disposed outside the data channels 611 in the Y-axis direction. Specifically, the data pads 631 may be disposed outside the data channels 611, respectively, in the +Y-axis direction and the −Y-axis direction.

The scan pads 641 may be respectively disposed outside the scan channels 621 in the Y-axis direction. Specifically, the scan pads 641 may be disposed outside the scan channels 621, respectively, in the +Y-axis direction and the −Y-axis direction.

Figure 13:
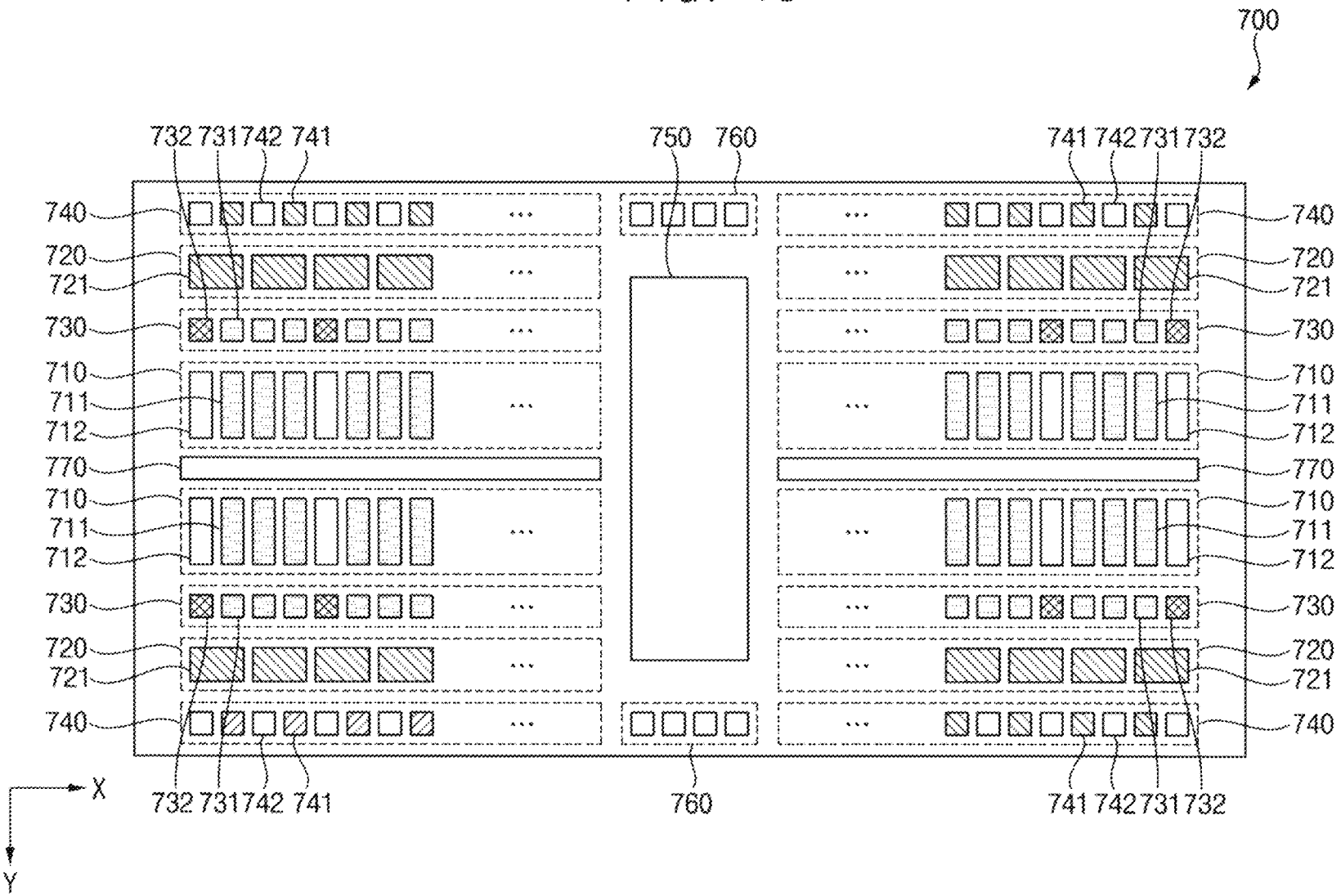
FIG. 13 is a diagram illustrating an embodiment of a driving chip.

FIG. 13 is a diagram illustrating an embodiment of a driving chip 700.

Referring to FIG. 13, a driving chip 700 may include a data channel block 710, a scan channel block 720, a data pad block 730, a scan pad block 740, a global circuit 750, an input pad block 760, and a logic circuit 770. Description of components of the driving chip 700 described with reference to FIG. 13, which are substantially the same as or similar to those of the driving chip 100 described with reference to FIG. 4, will be omitted.

The data channel block 710 may include a plurality of data channels 711. The data channels 711 may be arranged in the X-axis direction.

The data channel block 710 may further include at least one dummy channel 712. In an embodiment, the dummy channels 712 may be alternately arranged with data channel groups each including a plurality of data channels 711 in the X-axis direction. In other words, one dummy channel 712 may be alternately arranged with a plurality of data channels 711 in the X-axis direction.

The scan channel block 720 may include a plurality of scan channels 721. The scan channels 721 may be arranged in the X-axis direction. The scan channel block 720 may be disposed outside the data channel block 710 in the Y-axis direction.

The data pad block 730 may include a plurality of data pads 731. The data pads 731 may be arranged in the X-axis direction.

The data pad block 730 may further include at least one sensing pad 732. The sensing pad 732 may receive a sensing signal from the pixels PX disposed in the display panel 10. In an embodiment, the sensing pads 732 may be alternately arranged with data pad groups each including a plurality of data pads 731 in the X-axis direction. In other words, one sensing pad 732 may be alternately arranged with a plurality of data pads 731 in the X-axis direction.

The scan pad block 740 may include a plurality of scan pads 741. The scan pads 741 may be arranged in the X-axis direction.

The scan pad block 740 may further include at least one dummy pad 742. The dummy pad 742 may be electrically connected to the dummy channel 712. In an embodiment, the dummy pads 742 may be alternately arranged with the scan pads 741 in the X-axis direction. In other words, one dummy pad 742 may be alternately arranged with one scan pad 741 in the X-axis direction.

A distance between the scan pad block 740 and the scan channel block 720 may be less than a distance between the scan pad block 740 and the data channel block 710. In an embodiment, the scan pad block 740 may be disposed closer to the scan channel block 720 than to the data channel block 710 in the Y-axis direction, for example.

A distance between the data channel block 710 and the data pad block 730 may be less than a distance between the data channel block 710 and the scan pad block 740. In an embodiment, the data channel block 710 may be disposed closer to the data pad block 730 than to the scan pad block 740 in the Y-axis direction, for example.

The data pad block 730 may be disposed between the data channel block 710 and the scan channel block 720 in the Y-axis direction, and the scan channel block 720 may be disposed between the data pad block 730 and the scan pad block 740 in the Y-axis direction. In an embodiment, the data pad block 730 may be disposed outside the data channel block 710 in the Y-axis direction, the scan channel block 720 may be disposed outside the data pad block 730 in the Y-axis direction, and the scan pad block 740 may be disposed outside the scan channel block 720 in the Y-axis direction.

The logic circuit 770 may be disposed inside the data channel block 710 in the Y-axis direction. In an embodiment, the logic circuit 770 may be disposed at a center portion in the Y-axis direction in the driving chip 700. In an embodiment, a center of the logic circuit 770 in the Y-axis direction may correspond to a center of the driving chip 700 in the Y-axis direction, but the invention is not limited thereto. The logic circuit 770 may generate the data clock signal DCLK, the scan clock signal SCLK, or the like.

In the driving chip 700 in an embodiment, the distance between the scan pad block 740 and the scan channel block 720 may be less than the distance between the scan pad block 740 and the data channel block 710, and the distance between the data channel block 710 and the data pad block 730 may be less than the distance between the data channel block 710 and the scan pad block 740, so that interference between the data signal DS and the scan signal SS may be reduced or substantially prevented.

Figure 14:
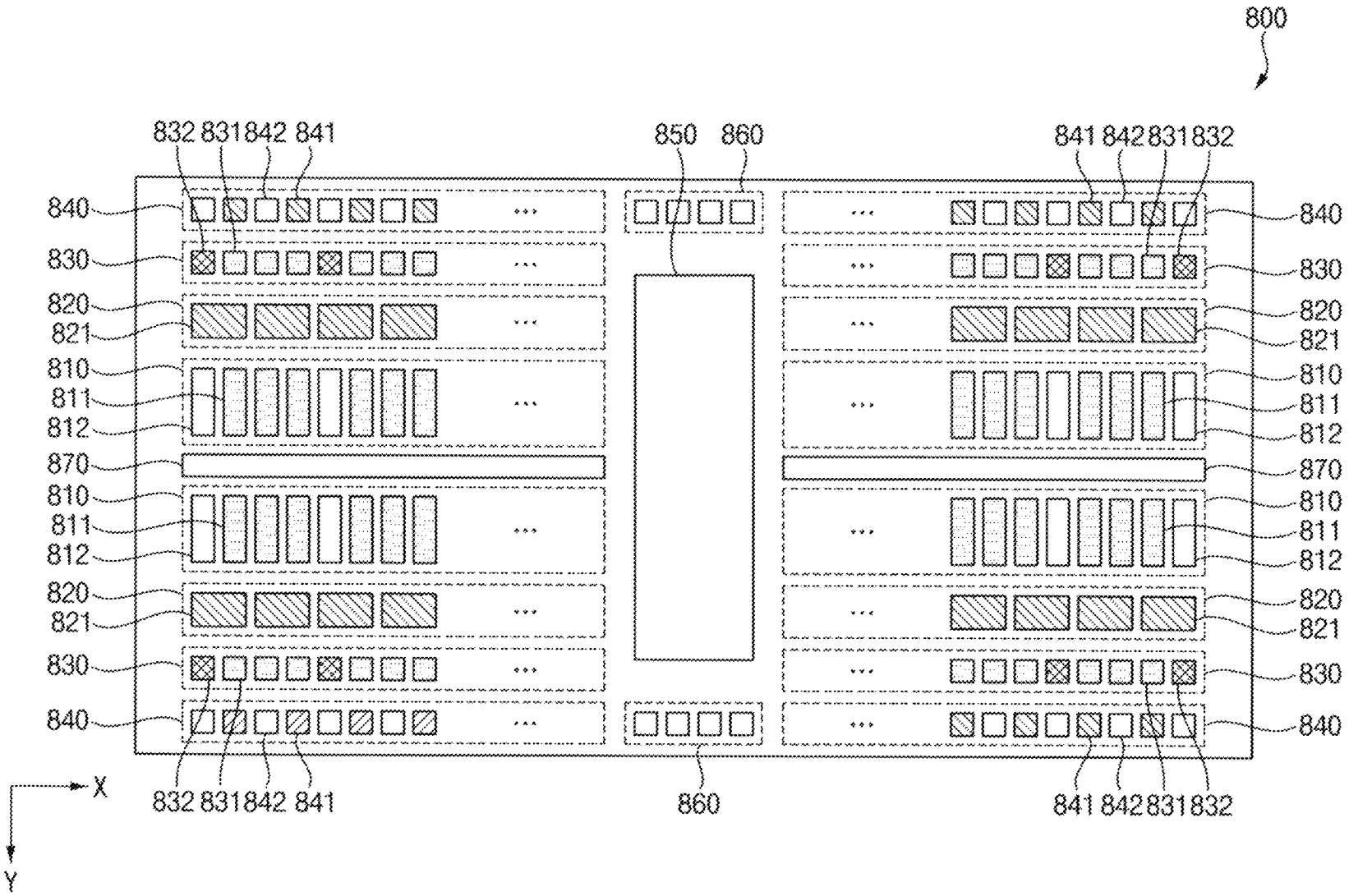
FIG. 14 is a diagram illustrating an embodiment of a driving chip.

FIG. 14 is a diagram illustrating an embodiment of a driving chip 800.

Referring to FIG. 14, a driving chip 800 may include a data channel block 810, a scan channel block 820, a data pad block 830, a scan pad block 840, a global circuit 850, an input pad block 860, and a logic circuit 870. The data channel block 810 may include a plurality of data channels 811 and at least one dummy channel 812, and the scan channel block 820 may include a plurality of scan channels 821. The data pad block 830 may include a plurality of data pads 831 and at least one sensing pad 832, and the scan pad block 840 includes a plurality of scan pads 841 and at least one dummy pad 842. The driving chip 800 described with reference to FIG. 14 may be substantially the same as or similar to the driving chip 700 described with reference to FIG. 13 except for positions of the scan channel block 820, the data pad block 830, and the scan pad block 840. Accordingly, descriptions of the overlapping components will be omitted.

The scan channel block 820 may be disposed between the data channel block 810 and the data pad block 830 in the Y-axis direction, and the data pad block 830 may be disposed between the scan channel block 820 and the scan pad block 840 in the Y-axis direction. In an embodiment, the scan channel block 820 may be disposed outside the data channel block 810 in the Y-axis direction, the data pad block 830 may be disposed outside the scan channel block 820 in the Y-axis direction, and the scan pad block 840 may be disposed outside the data pad block 830 in the Y-axis direction.

Figure 15:
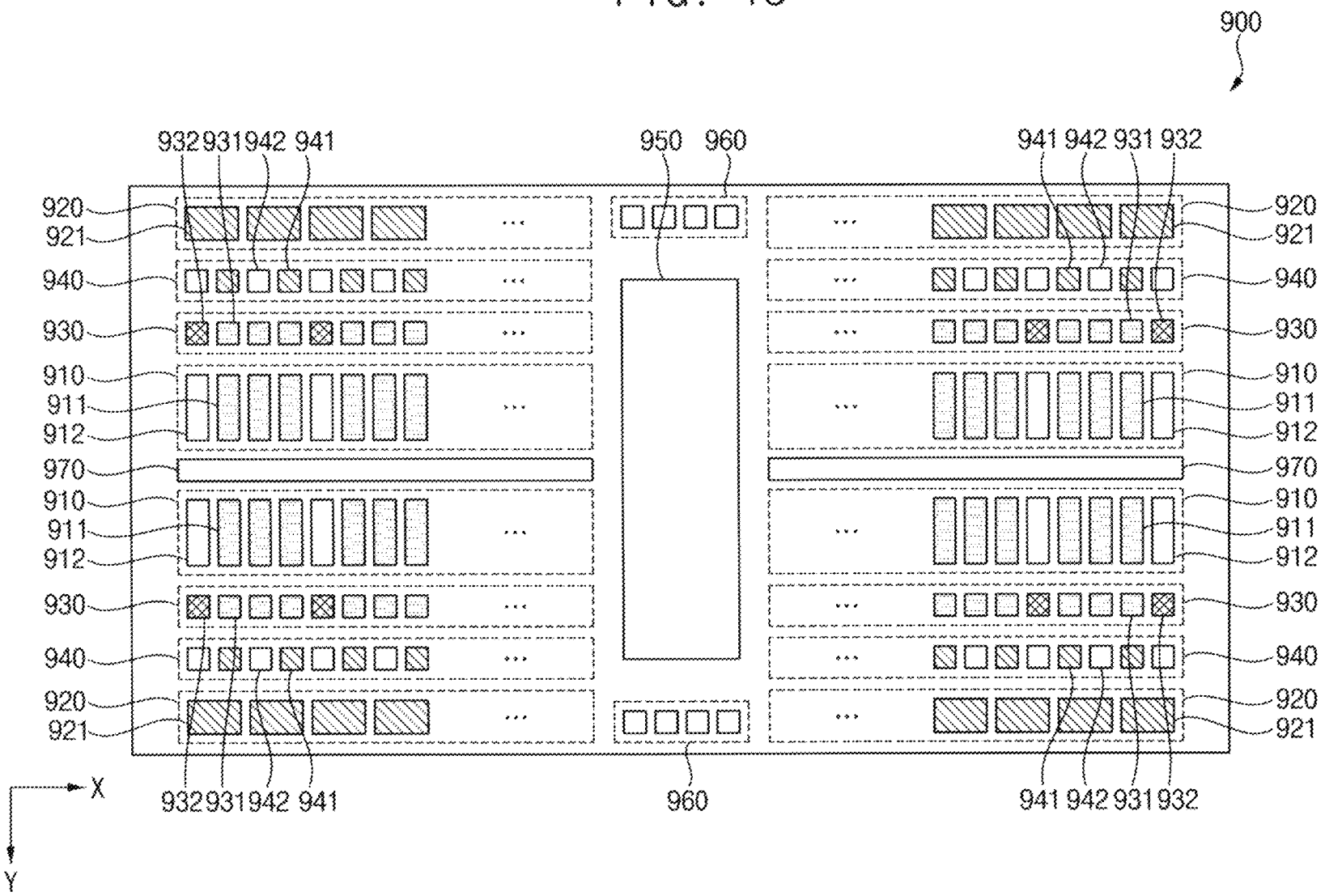
FIG. 15 is a diagram illustrating an embodiment of a driving chip.

FIG. 15 is a diagram illustrating an embodiment of a driving chip 900.

Referring to FIG. 15, a driving chip 900 may include a data channel block 910, a scan channel block 920, a data pad block 930, a scan pad block 940, a global circuit 950, an input pad block 960, and a logic circuit 970. The data channel block 910 may include a plurality of data channels 911 and at least one dummy channel 912, and the scan channel block 920 may include a plurality of scan channels 921. The data pad block 930 may include a plurality of data pads 931 and at least one sensing pad 932, and the scan pad block 940 includes a plurality of scan pads 941 and at least one dummy pad 942. The driving chip 900 described with reference to FIG. 15 may be substantially the same as or similar to the driving chip 700 described with reference to FIG. 13 except for positions of the scan channel block 920, the data pad block 930, and the scan pad block 940. Accordingly, descriptions of the overlapping components will be omitted.

The data pad block 930 may be disposed between the data channel block 910 and the scan pad block 940 in the Y-axis direction, and the scan pad block 940 may be disposed between the data pad block 930 and the scan channel block 920 in the Y-axis direction. In an embodiment, the data pad block 930 may be disposed outside the data channel block 910 in the Y-axis direction, the scan pad block 940 may be disposed outside the data pad block 930 in the Y-axis direction, and the scan channel block 920 may be disposed outside the scan pad block 940 in the Y-axis direction.

The driving chip and the display device in the embodiments may be applied to a display device included in a computer, a notebook, a mobile phone, a smart phone, a smart pad, a portable media player ("PMP"), a personal digital assistant ("PDA"), an MP3 player, or the like.

Although the driving chips and the display devices in the embodiments have been described with reference to the drawings, the illustrated embodiments are examples, and may be modified and changed by a person having ordinary knowledge in the relevant technical field without departing from the technical spirit described in the following claims.

What is claimed is:

1. A driving chip, comprising:

a data channel block including a plurality of data channels;

a scan channel block disposed in a first direction from the data channel block, and including a plurality of scan channels;

a data pad block disposed outside the data channel block and the scan channel block in the first direction, and including a plurality of data pads which respectively receive data signals from the plurality of data channels; and a scan pad block disposed outside the data channel block and the scan channel block in the first direction, disposed outside the data pad block in a second direction crossing the first direction, and including a plurality of scan pads which respectively receive scan signals from the scan channels.

2. The driving chip of claim 1, wherein the data channel block is disposed outside the scan channel block in the first direction.

3. The driving chip of claim 2, wherein each of the plurality of data channels extends in the first direction, and wherein each of the scan channels extends in the first direction.

4. The driving chip of claim 2, wherein each of the plurality of data channels extends in the first direction, and wherein each of the scan channels extends in the second direction.

5. The driving chip of claim 1, wherein the data channel block is disposed inside the scan channel block in the first direction.

6. The driving chip of claim 5, wherein each of the plurality of data channels extends in the first direction, and wherein each of the scan channels extends in the first direction.

7. The driving chip of claim 5, wherein each of the plurality of data channels extends in the first direction, and wherein each of the scan channels extends in the second direction.

8. The driving chip of claim 1, wherein each of the plurality of data channels includes:

a first shift register which generates a sampling signal based on a data clock signal;

a latch which stores an image data in response to the sampling signal;

a first level shifter which shifts a voltage level of a latch output signal outputted from the latch;

a digital-analog converter which performs a digital-analog conversion on a shifter output signal outputted from the first level shifter; and a first output buffer which outputs a data signal of the data signals outputted from the digital-analog converter.

9. The driving chip of claim 1, wherein each of the scan channels includes:

a second shift register which generates a scan signal of the scan signals based on a scan clock signal;

a second level shifter which shifts a voltage level of the scan signal outputted from the second shift register; and a second output buffer which outputs the scan signal outputted from the second level shifter.

10. The driving chip of claim 1, further comprising:

a global circuit disposed inside the data channel block and the scan channel block in the second direction; and a plurality of input pads disposed inside the data pad block in the second direction.

11. A driving chip, comprising:

a plurality of data channel groups arranged in a first direction, and each including a plurality of data channels arranged in the first direction;

a plurality of scan channels alternately arranged with the data channel groups in the first direction;

a plurality of data pads respectively disposed outside the plurality of data channels in a second direction crossing the first direction, and which respectively receive data signals from the plurality of data channels; and a plurality of scan pads which are respectively disposed outside the plurality of scan channels in the second direction, and respectively receive scan signals from the plurality of scan channels.

12. The driving chip of claim 11, wherein at least one of the plurality of data channels is disposed between two of the plurality of scan channels which are adjacent in the first direction.

13. The driving chip of claim 11, wherein each of the plurality of data channels extends in the second direction, and wherein each of the plurality of scan channels extends in the second direction.

14. A driving chip, comprising:

a data channel block including a plurality of data channels;

a scan channel block disposed outside the plurality of data channel block in a first direction, and including a plurality of scan channels;

a data pad block including a plurality of data pads which respectively receive data signals from the plurality of data channels; and a scan pad block including a plurality of scan pads which respectively receive scan signals from the plurality of scan channels, wherein a distance between the scan pad block and the scan channel block is less than a distance between the scan pad block and the data channel block.

15. The driving chip of claim 14, wherein a distance between the data channel block and the data pad block is less than a distance between the data channel block and the scan pad block.

16. The driving chip of claim 15, wherein the data pad block is disposed between the data channel block and the scan channel block in the first direction, and wherein the scan channel block is disposed between the data pad block and the scan pad block in the first direction.

17. The driving chip of claim 15, wherein the scan channel block is disposed between the data channel block and the data pad block in the first direction, and wherein the data pad block is disposed between the scan channel block and the scan pad block in the first direction.

18. The driving chip of claim 15, wherein the data pad block is disposed between the data channel block and the scan pad block in the first direction, and wherein the scan pad block is disposed between the data pad block and the scan channel block in the first direction.

19. The driving chip of claim 14, wherein the data channel block further includes at least one dummy channel, and wherein the scan pad block further includes at least one dummy pad electrically connected to the dummy channel.

20. The driving chip of claim 14, wherein the data pad block further includes at least one sensing pad which receives a sensing signal.

21. A display device, comprising:

a display panel including a plurality of pixels, a plurality of scan lines extending in a first extension direction and connected to the pixels, and a plurality of data lines extending in a second extension direction crossing the first extension direction and connected to the pixels; and a driving chip which provides data signals to the data lines, and which provides scan signals to the scan lines, the driving chip including:

a plurality of data channels;

a plurality of scan channels disposed in a first direction from the plurality of data channels;

a plurality of data pads which are disposed outside the plurality of data channels and the plurality of scan channels in the first direction, respectively receive the data signals from the plurality of data channels, and respectively provide the data signals to the data lines; and a plurality of scan pads which are disposed outside the plurality of data channels and the plurality of scan channels in the first direction, disposed outside the plurality of data pads in a second direction crossing the first direction, respectively receive the scan signals from the plurality of scan channels, and respectively provide the scan signals to the scan lines.

22. The display device of claim 21, wherein the second direction is identical to the first extension direction.

23. The display device of claim 21, wherein the second direction is identical to the second extension direction.

* * * * *